US006302525B1

(12) United States Patent
Janse Van Rensburg et al.

(10) Patent No.: US 6,302,525 B1
(45) **Date of Patent: *Oct. 16, 2001**

(54) INKJET PRINTER NOZZLE PLATE

(75) Inventors: Richard Wilhelm Janse Van Rensburg; Guy Charles Fernley Newcombe, both of Cambridge (GB)

(73) Assignee: Tonejet Corporation Pty Ltd., Eastwood (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/101,891

(22) PCT Filed: Jan. 22, 1997

(86) PCT No.: PCT/GB97/00188

§ 371 Date: Jul. 17, 1998

§ 102(e) Date: Jul. 17, 1998

(87) PCT Pub. No.: WO97/27060

PCT Pub. Date: Jul. 31, 1997

(30) Foreign Application Priority Data

Jan. 22, 1996 (GB) ..... 9601212

(51) Int. Cl.[7] ..... B41J 2/14

(52) U.S. Cl. ..... 347/47; 347/94; 347/67

(58) Field of Search ..... 347/47, 22, 94, 347/93, 67

(56) References Cited

U.S. PATENT DOCUMENTS 5,838,350 * 11/1998 Newcombe ..... 347/68

FOREIGN PATENT DOCUMENTS

402277646 * 11/1990 (JP) ..... 347/93
403005158 * 1/1999 (JP) ..... 347/93

OTHER PUBLICATIONS

Merriam–Webster's Dictionary, Tenth Edition.*

* cited by examiner

*Primary Examiner*—Thinh Nguyen
*Assistant Examiner*—Manish S. Shah
(74) *Attorney, Agent, or Firm*—Dykema Gossett PLLC

(57) ABSTRACT

A nozzle plate apparatus for an inkjet printer has a nozzle aperture (8) which includes a plurality of elements (9) sub-dividing the aperture into a plurality of smaller apertures.

4 Claims, 2 Drawing Sheets

INKJET PRINTER NOZZLE PLATE

BACKGROUND OF THE INVENTION

The present invention relates to nozzle plate for an inkjet printer having a nozzle aperture through which ink is dispensed.

It is known in the field of fluid mechanics and in inkjet printing technology that, if a liquid is held in an container and that container has a hole in it with the hole below the level of the surface of the liquid, the liquid will not necessarily leak from the container depending upon the parameters of the liquid and the hole. The parameters which determine whether or not the liquid leaks from the container or not are the size of the hole, the surface tension of the liquid, the surface energy of the material in which the hole is formed, the vertical height of the liquid above the hole and the force of gravity. In inkjet printer systems, for example the so-called "BubbleJet" printers, additional means are used to control the pressure which the liquid exerts on the hole, typically in the form of an open cell foam structure. The surface tension force of the liquid acting in the capillaries of the foam at the liquid/air interface on the external surface of the foam can generate a back pressure which is able to balance the weight of the liquid in the foam.

There can be occasions when it is beneficial to have a large hole or slit in an inkjet printer, but where it is not feasible to use an open cell foam structure in order to exert a back pressure. For example, WO-A-93-11866, PCT/GB95/01215 and WO-A-94-18011 all disclose printing methods where a large slit may be useful.

It is desirable therefore to provide an alternative mechanism for ink retention.

SUMMARY OF THE INVENTION

According to the present invention there is provided a nozzle plate apparatus for an inkjet printer having a nozzle aperture which includes a plurality of elements sub-dividing the aperture into a plurality of smaller apertures.

Preferably, the nozzle aperture includes a material disposed within the aperture and comprising a plurality of strands.

The aperture may be an elongate slit.

A particular feature of the invention is that one can sub-divide an aperture in a liquid containing vessel of dimensions which would otherwise normally allow liquid to escape due to gravity. Sub-dividing the aperture as proposed by the present invention effectively produces a number of small orifices of dimensions which allow the surface tension of the liquid to prevent the liquid from escaping. The invention also allows what is, in effect, a local reservoir of fluid to be retained close to the ejection location which can be used to improve the supply of fluid to the ejection location and the supply of charged particles to the ejection location. This is of use in printers of the type to which the invention relates as these are capable of operating at very high speeds.

The strands dividing the aperture into a plurality of apertures may be provided by the walls of a foam structure deposited in the nozzle aperture or else by individual filaments arranged substantially orthogonal to a major axis of the aperture, for example.

BRIEF DESCRIPTION OF THE SEVERAL VIEWS OF THE DRAWING

One example of a nozzle plate assembly according to the present invention will now be described with reference to the accompanying drawings in which.

DETAILED DESCRIPTION OF THE INVENTION

The figures illustrate printers of the type generally described in the above mentioned patent specifications.

Figure 2:
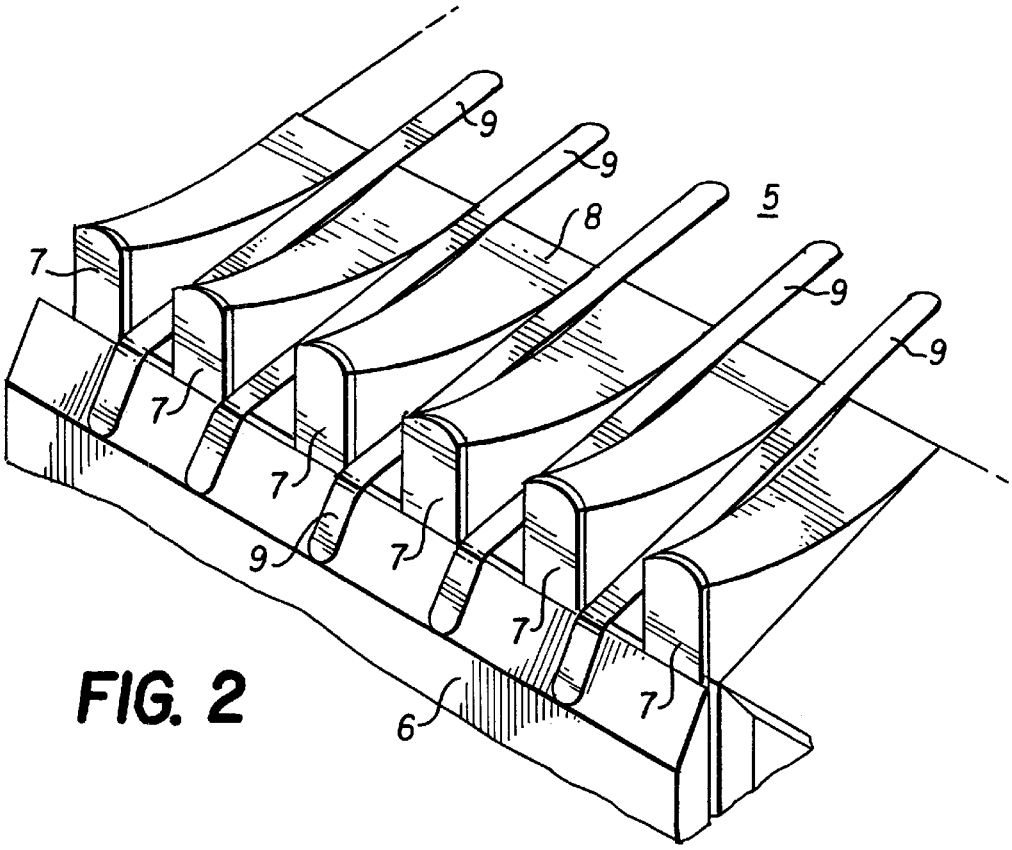
FIG. 2 is a close-up view of the nozzle plate aperture.

In the printhead of FIGS. 1 to 4, the printhead 1 has a flow of ink, in this case, an ink having particles which are dispensed according to the method described in WO-A-93-11866, the ink 2 flowing around an angled path 3,4 behind nozzle plate component 5,6. The nozzle plate 6 contains a series of protruding electrodes 7 which are spaced apart from one another as seen in FIG. 2 and which project from a slit-like aperture 8.

Between each of the electrodes 7 are providing nylon filaments 9 which sub-divide the slit 8 between the two component parts 5, 6 of the nozzle plate into segments corresponding to each of the electrodes 7.

FIG. 2 shows how, under the action of the surface tension of the liquid, plural liquid menisci are formed, from which the ink is dispensed, in use, as described in the above mentioned patent specifications.

Figure 1:
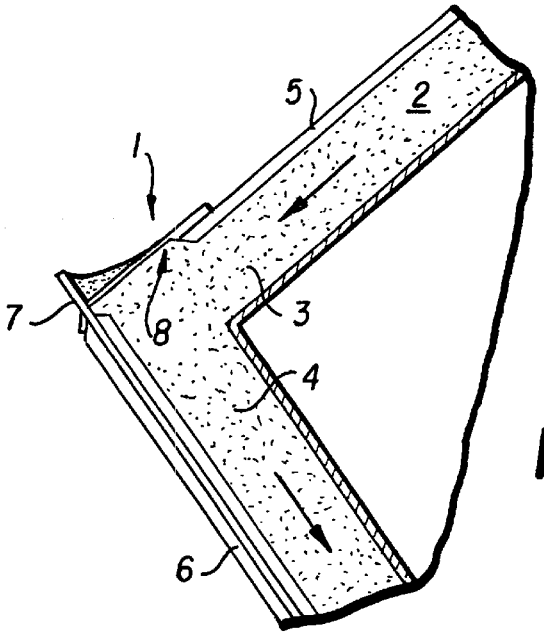
FIG. 1 is a cross-sectional view of an array type inkjet printhead.
Figure 3:
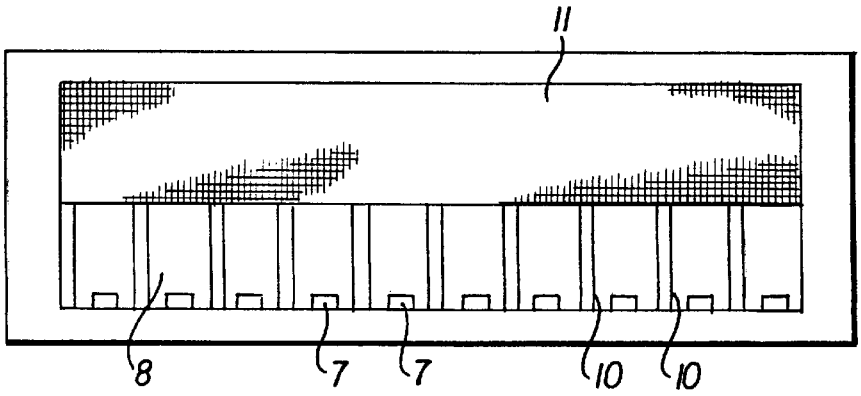
FIGS. 3 and 4 are cross-sectional views through alternative embodiments.
Figure 4:
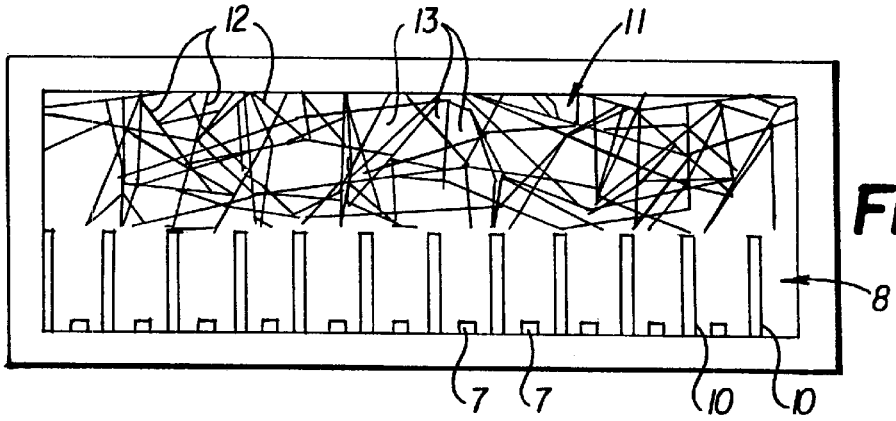

The example shown in FIGS. 3 and 4 has a slot 8 which is partially sub-divided by walls 10 which extend part of the way across the slot. FIG. 4 illustrates the internal structure of the foam 11 indicated generally in FIG. 3. Between each pair of walls is an electrode 7 and in the space between the free ends of the walls 10 and the other side of the slot 8 there is provided Basotect foam 11. The foam 11 prevents the liquid from escaping and provides a plurality of strands 12 which, when taken in association with the walls, divide the slit into a plurality of apertures 13. FIG. 4 illustrates the strands 12 in relation to their depth in the figure by way of the darkness of the strands, darker strands being nearer the surface of the cross-section.

In a modification of this construction the foam could be replaced by individual strands of the type for example as shown in FIG. 2.

Figure 5:
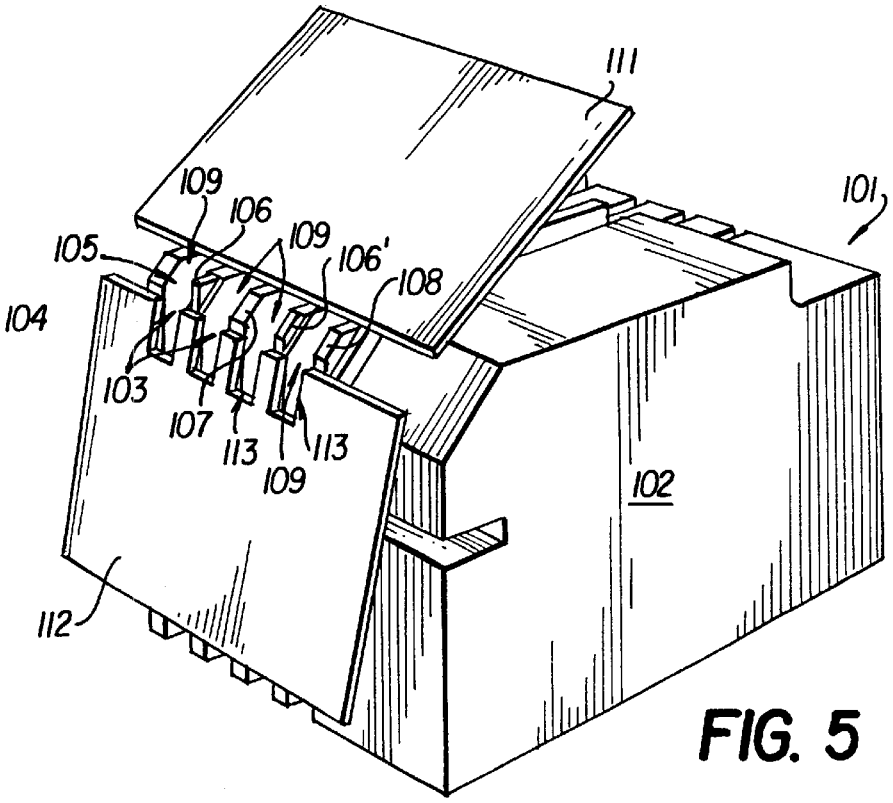
FIG. 5 is a partial perspective view of a portion of a further printhead incorporating ejection apparatus according to the present invention.

Another example is illustrated in FIG. 5. FIG. 5 illustrates part of an array-type printhead 1, the printhead comprising a body 2 of a dielectric material such as a synthetic plastics material or a ceramic. A series of grooves 103 are machined in the body 2, leaving interposing plate-like lands 104. The grooves 3 are each provided with a ink inlet and ink outlet (not shown, but indicated by arrows I & O) disposed at opposite ends of the grooves 103 so that fluid ink carrying a material which is to be ejected (as described in our earlier applications) can be passed into the grooves and depleted fluid passed out.

Each pair of adjacent grooves 103 define a cell 105, the plate-like land or separator 104 between the pairs of grooves 103 defining an ejection location for the material and having an ejection upstand 106, 106'. In the drawing two cells 105 are shown, the left-hand cell 5 having an ejection upstand 6 which is of generally triangular shape and the right-hand cell 105 having a truncated ejection upstand. Each of the cells 5 is separated by a cell separator 107 formed by one of the plate-like lands 104 and the corner of each separator 107 is shaped or chamfered as shown so as to provide a surface 108 to allow the ejection upstand to project outwardly of the cell beyond the exterior of the cell as defined by the chamfered surfaces 108. A truncated ejection upstand 106' is used in the end cell 105 to reduce end effects resulting from the electric fields which in turn result from voltages applied to ejection electrodes 109 provided as metallised surfaces on the faces of the plate-like lands 104 facing the ejection upstand 106, 106' (ie. the inner faces of each cell separator). The ejection electrodes 109 extend over the side faces of the lands 104 and the bottom surfaces of the grooves 103. The precise extent of the ejection electrodes 109 will depend upon the particular design and purpose of the printer.

FIG. 5 illustrates two alternative forms for side covers of the printer, the first being a simple straight-edged cover 111 which closes the sides of the grooves 103 along the straight line as indicated in the top part of the figure. A second type of cover 112 is shown on the lower part of the figure, the cover still closing the grooves 103 but having a series of edge slots 13 which are aligned with the grooves. This type of cover construction may be used to enhance definition of the position of the fluid meniscus which is formed in use and the covers, of whatever form, can be used to provide surfaces onto which the ejection electrode and/or secondary or additional electrodes can be formed to enhance the ejection process. Additionally, the fingers 115 between the edge slots 113 serve to reduce the overall size of the aperture between the opposed covers 111, 112, thus acting in accordance with the invention, to sub-divide the aperture into smaller apertures.

In all the examples referred to above, sub-dividing the basic aperture into plural smaller ones allows a larger basic aperture to be used (without the risk of leakage) which, in turn, allows an increased migration of material for ejection within the liquid in the device.

What is claimed is:

1. A nozzle plate apparatus for an inkjet printer having a nozzle aperture, said aperture having an outlet, and said aperture outlet including a plurality of strands disposed across the aperture outlet, thereby subdividing the aperture outlet into a plurality of smaller aperture outlet portions.

2. An apparatus according to claim 1, wherein said aperture outlet comprises an elongate slit.

3. An apparatus according to claim 1, wherein the strands are provided by a foam structure deposited in or adjacent to the nozzle aperture outlet.

4. An apparatus according to claim 2, wherein the strands comprise filaments arranged substantially orthogonal to the longitudinal axis of the aperture outlet.

* * * * *